US005342171A

United States Patent [19]

Stanko

[11] Patent Number: 5,342,171

[45] Date of Patent: Aug. 30, 1994

[54] IMPELLER BLADE WITH REDUCED STRESS

[75] Inventor: Michael J. Stanko, Grand Island, N.Y.

[73] Assignee: Praxair Technology, Inc., Danbury, Conn.

[21] Appl. No.: 128,503

[22] Filed: Sep. 29, 1993

Related U.S. Application Data

[63] Continuation-in-part of Ser. No. 872,345, Apr. 23, 1992, abandoned.

[30] Foreign Application Priority Data

| | | | |
|---|---|---|---|
| Apr. 8, 1993 | [TH] | Thailand | 018679 |
| Apr. 20, 1993 | [ID] | Indonesia | 93-005883 |
| Apr. 22, 1993 | [AR] | Argentina | 324798 |
| Apr. 22, 1993 | [BR] | Brazil | PI9301625 |
| Apr. 22, 1993 | [CA] | Canada | 2094624 |
| Apr. 22, 1993 | [CL] | Chile | 93-00436 |
| Apr. 22, 1993 | [CN] | China | 93-104927 |
| Apr. 22, 1993 | [EP] | European Pat. Off. | 93106559 |
| Apr. 22, 1993 | [JP] | Japan | 5-117598 |
| Apr. 22, 1993 | [KR] | Rep. of Korea | 93-06762 |
| Apr. 22, 1993 | [MX] | Mexico | 93-02366 |

[51] Int. Cl.[5] ..... F04D 29/18

[52] U.S. Cl. ..... 415/228; 416/223 A

[58] Field of Search ..... 416/223 B, 223 R, 223 A, 416/179, 177, 185, 188, 190; 415/228, 268.1

[56] References Cited

U.S. PATENT DOCUMENTS

| | | | |
|---|---|---|---|
| 1,959,703 | 5/1934 | Birmann | 230/134 |
| 2,390,504 | 12/1945 | Berger | 416/181 |
| 2,483,335 | 9/1949 | Davis | 415/218.1 |
| 2,625,794 | 1/1953 | Williams et al. | 415/218.1 |
| 2,873,945 | 2/1959 | Kuhn | 253/39.15 |
| 2,941,780 | 6/1960 | VonderNuell et al. | 253/39 |
| 2,977,088 | 3/1961 | Buchi | 253/39 |
| 3,013,501 | 12/1961 | Ygge | 415/228 |
| 3,260,443 | 7/1966 | Garnett et al. | 415/218.1 |
| 3,310,940 | 3/1967 | Oetliker | 60/39.36 |
| 3,692,422 | 9/1972 | Girardier | 415/218.1 |
| 4,335,997 | 6/1982 | Ewing et al. | 416/185 |
| 4,460,313 | 7/1984 | Austrem | 415/178 |
| 4,682,935 | 7/1987 | Martin | 416/223 |
| 4,923,370 | 5/1990 | Larson et al. | 416/96 |

FOREIGN PATENT DOCUMENTS

| | | | |
|---|---|---|---|
| 278408 | 10/1930 | Italy | 416/185 |
| 628052 | 8/1949 | United Kingdom | 416/185 |

*Primary Examiner*—John T. Kwon

*Attorney, Agent, or Firm*—Peter Kent; Chung K. Pak

[57] ABSTRACT

A fluid impeller blade with lowered stress and increased useful life has an edge extending from the hub of the blade and forming, in part, a boundary for axial fluid flow. The edge, at least at its extremity, is spaced axially into the blade, at an angle of about 0.5° to about 20° from the radial line through the edge at the hub of the blade, whereby the mass of blade material exerting centrifugal force on the edge at the blade hub during rotation of the impeller is reduced.

10 Claims, 4 Drawing Sheets

IMPELLER BLADE WITH REDUCED STRESS

This is a continuation in part of U.S. application Ser. No. 07/872,345 filed Apr. 23, 1992.

TECHNICAL FIELD

This invention relates generally to blades in a shrouded radial flow turbine impeller, and, more particularly, to an improved turbine blade with reduced centrifugal stress and improved useful life.

BACKGROUND OF THE INVENTION

Radial flow impellers find application in gas turbine engines where they are used as compressor impellers and turbine impellers. Another application is in the expansion of gases for cooling in refrigeration plants and in gas liquefication plants. Radial flow impellers are greatly subject to structural constrictions in design because of aerodynamic considerations.

In a radial turbine impeller, gas flows into the impeller in a radial direction, entering channels formed by the impeller hub and the impeller blades. Typically, to achieve high aerodynamic performance, the impeller blades at their outer extremities have an integral shroud which forms the outer boundary of the fluid flow channels. The gas is expanded and turned in the impeller from the radial direction to discharge in the axial direction. Thus, the discharge face of the impeller is a generally radial plane, and the blades edges are radial. The blade edges define a large exit area for the expanded axial flow. Consequently, this face is termed the impeller eye. To provide the large exit area, the blade edges have a large radial span. Since these edges in a turbine impeller are trailing edges, they must be thin to provide good aerodynamic performance.

Stresses concentrate at the hub of the blade at the trailing edge. This location is therefore susceptible to cracking, and is critical in establishing the cyclic life of the impeller. Centrifugal stress is a large portion of the total stress at this critical location. The outer shroud is a large contributor to this centrifugal stress. Unshrouded impellers, on the other hand, do not experience such severe stress at this critical location, but have the disadvantage of significantly poorer aerodynamic performance.

The prior art has attempted to reduce stresses at the critical location by configuring the blade geometry. One technique has been simply to use thick trailing edges with attendant poorer aerodynamic performance. To reduce the aerodynamic performance penalty, the thickness of the blade trailing edge has also been tapered, that is, progressively reduced in thickness from the hub of the blade to the tip of the blade. Stress is reduced in that the mass of blade material exerting centrifugal force on the critical location is reduced.

Another technique used in the prior art has been to locate an annular recess on the eye face of the impeller hub at a radius somewhat less than the radius where the blades begin. This annulus introduces some flexibility into the connection of the blade edge with the hub at the eye face, thereby reducing stress in the blade edge at its intersection with the hub. This is especially true for combined blade and shoud material removal where the anticipated aerodynamic efficiency loss for a 5° bevel is only 0.25%.

SUMMARY OF THE INVENTION

This invention provides a radial inflow turbine impeller blade with reduced stress at a critical location, and consequently a blade with increased useful life. The blade comprises a surface for fluid engagement having a blade hub, an outer shroud and an edge defining, in part, an outlet opening for axial fluid flow. The edge extends from the blade hub, and, at least at its outer radial extremity, is spaced axially into the blade at an angle of about 0.5° to about 20° from the radial line through the edge at the hub of the blade. Thereby, the mass of blade material exerting centrifugal force on the edge at the blade hub during rotation of the impeller is reduced, and consequently the centrifugal force itself is reduced.

In a preferred embodiment, the blade edge at the eye of the impeller, that is, the outlet opening of the turbine impeller, from blade hub to blade extremity, is progressively spaced into the impeller.

In another embodiment, the blade has an outer shroud except over an angle of from about 0.5° to about 20° from a radial line extending through the edge at the blade hub.

DETAILED DESCRIPTION

Figure 1:
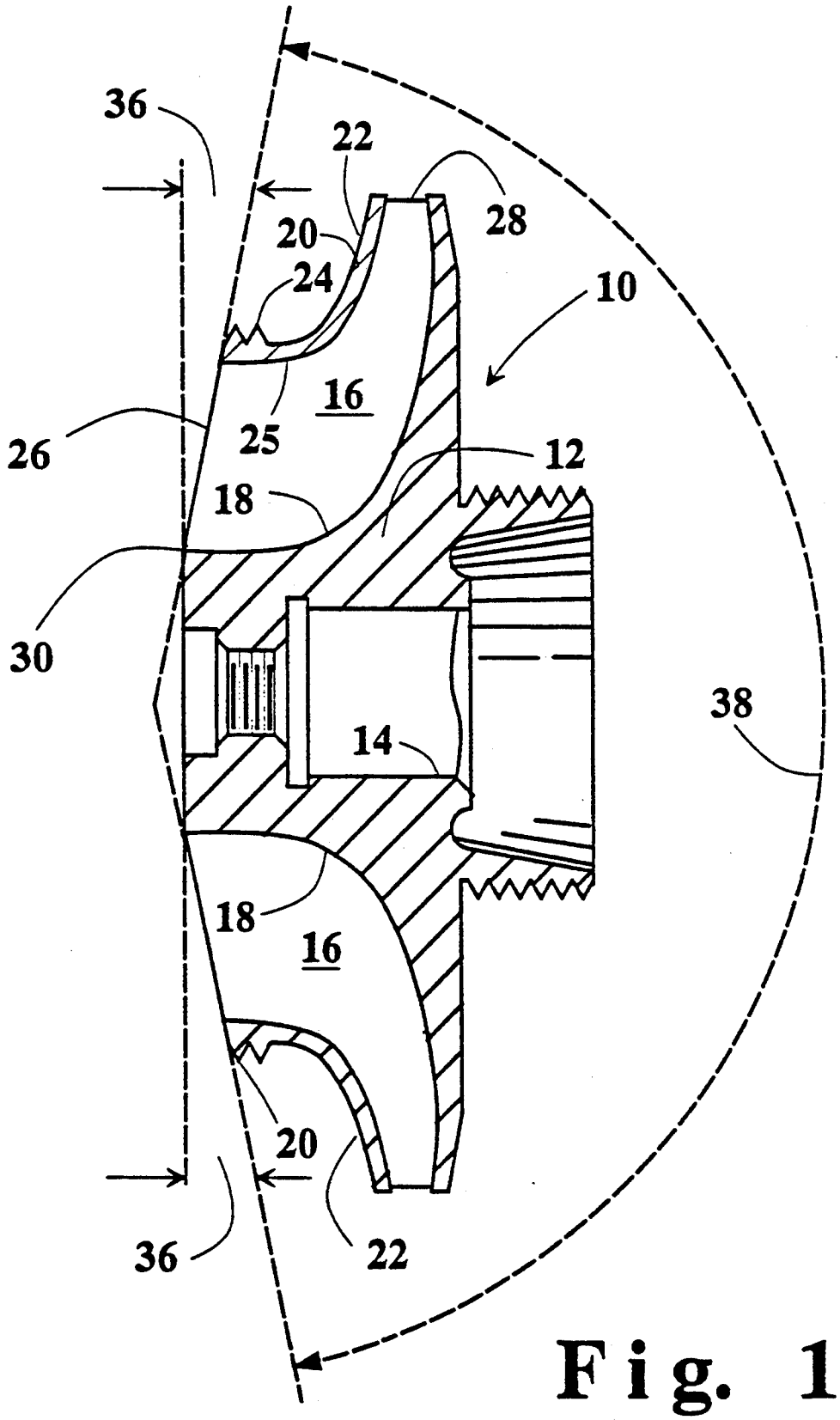
FIG. 1 is a cross sectional view of a turbine impeller showing one embodiment of the invention.

Depicted in FIG. 1 is a radial flow impeller 10 having a hub 12 with a central bore 14 for mounting of the impeller on a shaft. Extending from the hub 12 are blades 16 which together with the outer boundary of the hub define individual channels for fluid flow. The intersection of each blade with the hub is termed the blade hub 18. The blade surfaces engage the fluid flow and are the principal means for transfer of energy between the fluid and the impeller. Integral with the outer extremity 20 of the blades is a circumferentially-continuous outer shroud 22. The outer shroud provides a solid outer boundary for fluid flow in the channels formed by the blades and the hub, and allows high efficiency to be achieved. The outer shroud includes circumferentially-continuous projections 24 to serve as a labyrinth seal. The intersection of each blade with the outer shroud is also termed the blade tip 25.

At one extremity of the channels, the blade edges 26 form channel openings of relatively large flow area axially aligned for fluid flow. This face is termed the eye of the impeller. At the other extremity of the channels, the blade edges 28 form openings of relatively small flow area radially aligned for fluid flow. The channels are curved between the openings to guide and cause the fluid flow to change between the axial and radial directions. When the impeller is used in a compressor, the fluid enters the eye of the impeller, and is accelerated in the impeller. When the impeller is used in a turbine, the fluid exits at the eye of the impeller, and is decelerated in the impeller.

During steady-state operation, the impeller is subject to steady-state centrifugal, fluid pressure and thermal loads. Typically the highest steady-state stresses in a blade occur along or near the line of intersection of each blade with the hub, that is, the blade hub 18. The peak stress in this line 18 occurs at a location 30 close to or at the blade edge at the eye of the impeller. In an expansion, that is, turbine impeller, the blade edge at the eye is thin for high aerodynamic efficiency. This feature results in a small cross section for load bearing and high stress.

In addition to the steady-state loads, the fluid entering and leaving the impeller channels excites vibrational modes in the impeller thereby imposing dynamic loads. The blade edge at the eye hub experiences the highest stresses from dynamic excitation of blade bending modes. The combination of the steady-state and dynamic loads cause the highest stress to occur at the blade hub edge at the eye of the impeller. This location 30 is consequently susceptible to crack initiation, and its stress condition is critical in determining the useful life of the impeller.

Centrifugal load produces the majority of the stress at the critical location 30. The outer shroud 22 causes a large contribution to this load. An unshrouded blade does not experience such severe stresses and does not pose the severe stress problem that a shrouded blade does. Modifications to a shrouded blade to reduce the centrifugal load imposed by the shroud are particularly efficacious in increasing the operational life of the impeller. This is accomplished in the blade configuration provided by this invention.

As shown in FIG. 1, at a location radially removed from the blade hub, the blade edge 26 forming the axial flow opening in the impeller is spaced axially into the impeller relative to the blade edge at the hub. This reduces the mass which exerts centrifugal loading on the critical location, and, therefore, the centrifugal stresses, at the critical location. In a preferred embodiment, the blade edge 26 is progressively spaced axially into the impeller from the blade hub to the blade extremity. For fabrication ease, the blade edge is straight and is termed a beveled edge. Thus, the impeller face at the eye from the blade hub radially outward has the shape of the surface of a cone with its vertex on the impeller centerline with a selected included angle 38.

In a modification of the preferred embodiment, the bevel begins at a circumference on the eye face of the impeller other than the blade hub. In one embodiment, for instance, the blade is beveled from blade midchannel to blade tip including the shroud. Thus the impeller at the face having openings for axial flow, at least at its extremity, has the shape of the surface of a cone with its vertex on the impeller centerline, the vertex having an included angle selected to be from about 140° to about 176°. Somewhat higher aerodynamic efficiency results with such a partial bevel compared to a bevel of the entire blade edge. However, a larger bevel angle is required to produce a stress reduction equal to that of a bevel initiating at the blade hub.

In yet another modification of the preferred embodiment, the blade edge at the eye, rather than being linear, is curvilinear (not shown). A curvilinear blade edge, such as a parabolic segment, can produce slightly lower stress at the critical location 30 than a straight edge. In such a configuration, the impeller eye face from the blade hub outward has a more complex surface than that of a cone. The fabrication of such an impeller presents greater difficulty than fabrication of an impeller with straight blade edges at the eye.

Figure 2:
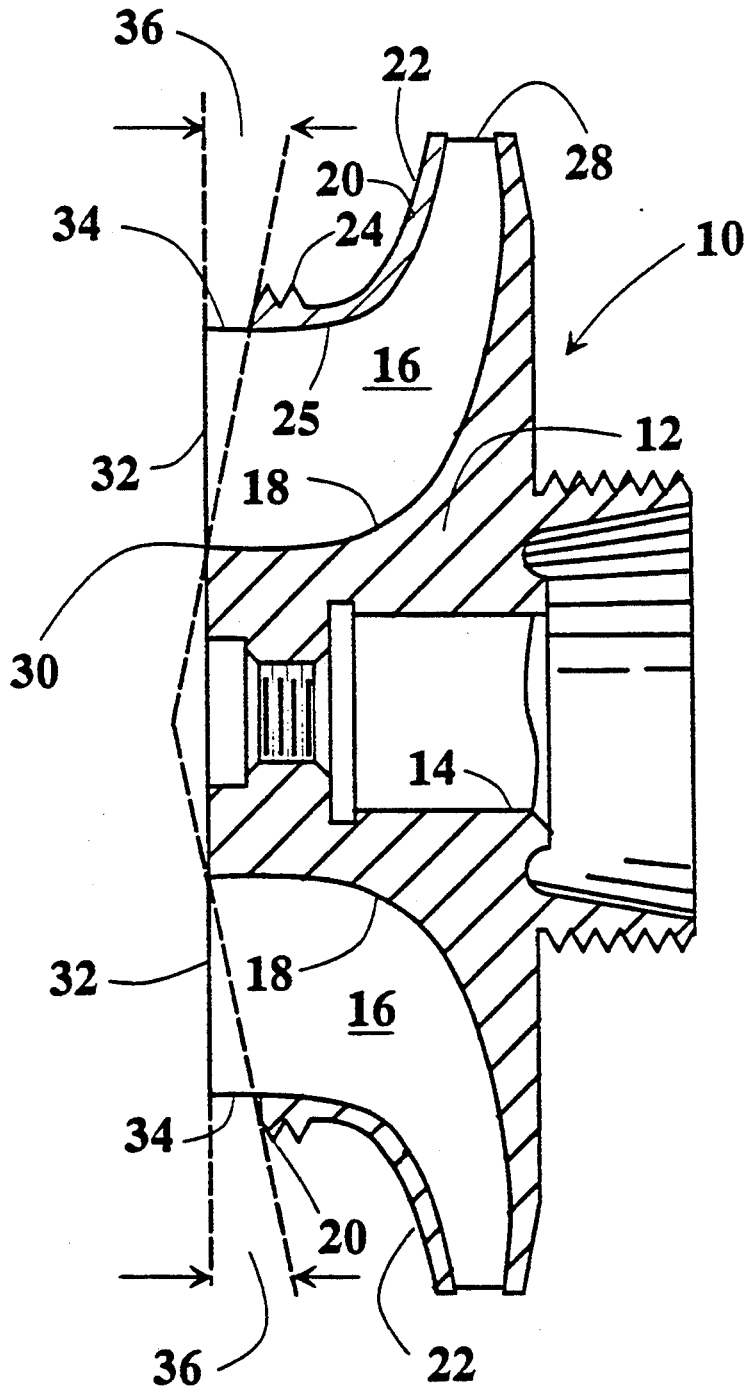
FIG. 2 is a cross sectional view of a turbine impeller showing another embodiment of the invention.

In another embodiment of the invention, as shown in FIG. 2, the blade edge 32 at the eye is radial, but the blade is unshrouded for a short length 34 from the eye face. The remainder of the blade includes a shroud 22 in order to achieve acceptable aerodynamic performance. The centrifugal loading on the critical location 30 is reduced in that the mass of material acting on the critical location is reduced. To reduce the small loss in efficiency resulting from the unshrouded portion of the blade extremity, a stationary shroud (not shown) may be optionally fitted to this area. The stationary shroud closely approaches, but does not contact the blade extremity.

Figure 3:
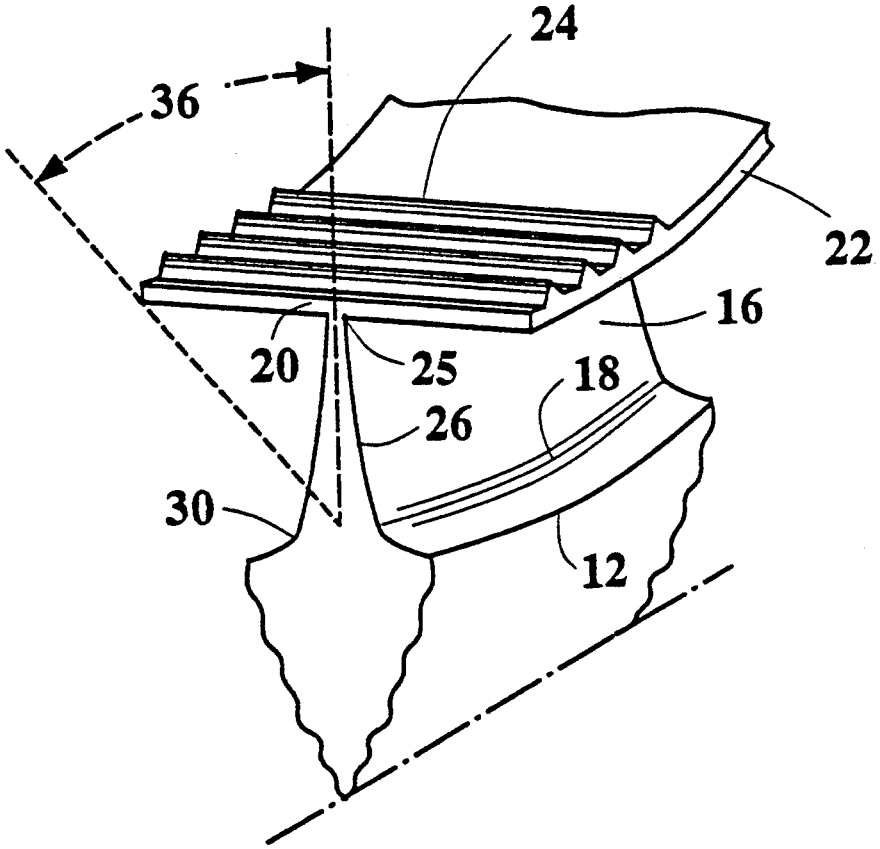
FIG. 3 is a view of a turbine blade partly in section showing another embodiment of the invention having blades tapered in thickness.

In all of the aforementioned embodiments, at least a portion of the surface of the blade 16 may be radially tapered in thickness, whereby the mass of the blade is reduced in radially approaching the blade extremity, giving rise to the embodiment illustrated in FIG. 3.

For convenience, a reference or bevel angle 36 is defined as the angle between a radial line through the blade edge at the blade hub and a line from the blade edge at the hub through the extremity of the blade edge. For all the aforementioned embodiments of the invention, the range of operable reference or bevel angles is from about 0.5° to about 20°. The preferred range is from about 3° to about 12°. The most preferred range is from about 3° to about 8°. However it is unexpected and surprising that a large decrease in stress is obtained at small reference or bevel angles, so that the range of about 0.5 to about 5° is very effective in reducing the blade stress.

EXAMPLE

Figure 4:
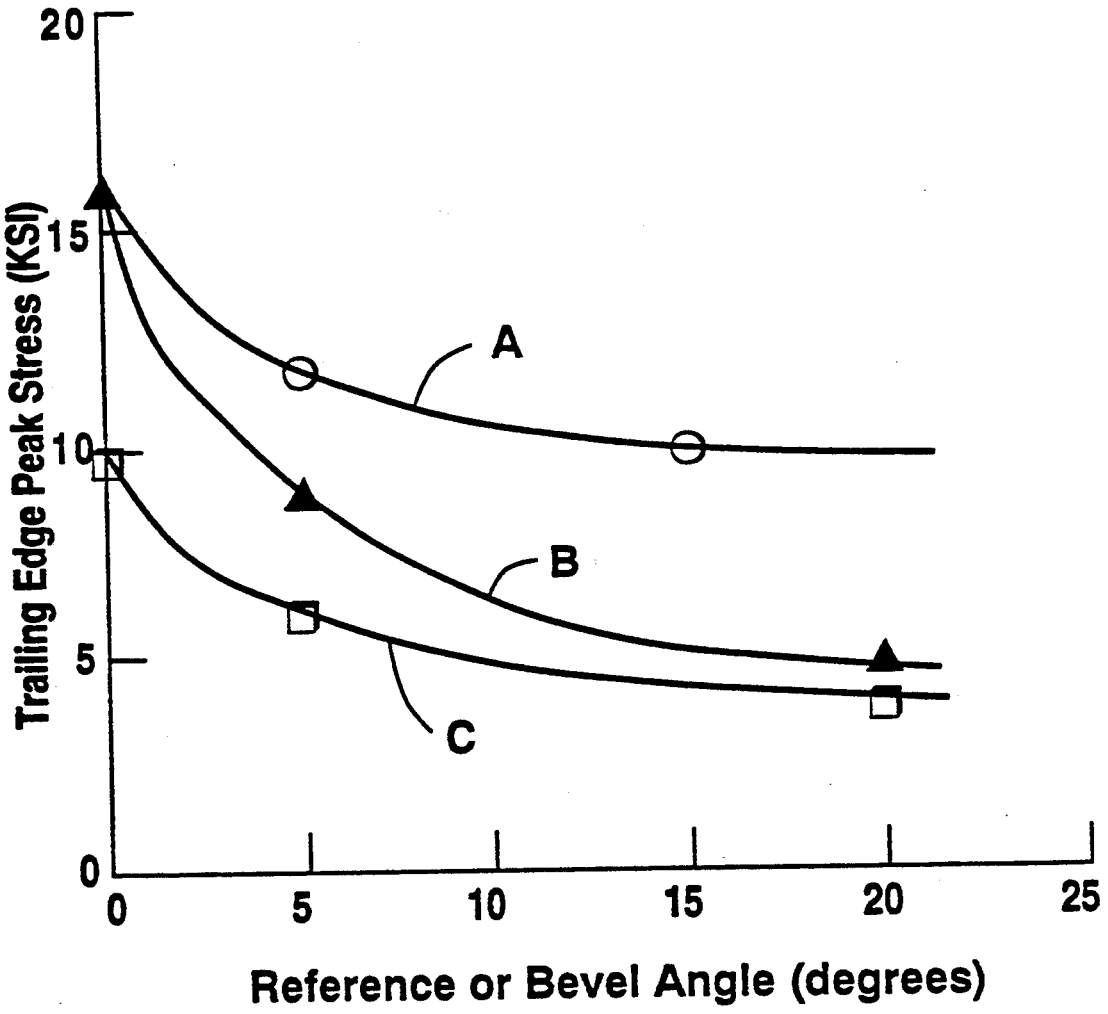
FIG. 4 is a graph showing the stress obtained at the critical location in a radial turbine impeller, that is, at the hub edge of the blade at the eye of the impeller, for various degrees of outer shroud absence and for various degrees of beveling of the trailing edges of the blade.

An expander impeller fabricated from 7175-T74 aluminum has a radial fluid inlet at a diameter of 5.2 inches. The blades have an integral outer shroud which includes projections for a labyrinth seal. The axial outlet at the eye has a blade hub diameter of 1.3 inches and a outer diameter including the shroud of 3.5 inches. Air enters at 300 psia, 440° R., exits at 80 psia, 300° R., and spins the impeller at 55,000 rpm. The impeller blades at the eye are beveled from blade hub to tip according to the preferred embodiment of the invention. In FIG. 4, line B shows the stress at the critical location in the impeller, that is, at the hub edge of the blades at the eye, as a function of the bevel angle. Line A shows the stress at the critical location resulting solely from removal of the shroud as a function of reference angle from the eye face of the impeller, pursuant to another embodiment of the invention. Significant reductions in stress are achieved in both embodiments. However it is unexpected and surprising that a large reduction in stress is obtained at the critical location at small reference or bevel angles, so that the range of about 0.5 to about 5° is very effective in reducing the blade stress at the critical location.

The penalty in efficiency caused by a bevel angle of 5°, or by unshrouding over 5°, is estimated at 0.25%. The penalty in efficiency escalates increasingly with increased angle. However, at a modest bevel angle of 5°, a stress reduction from 17,000 psi to 10,000 psi, a reduction of 41%, is obtained at the critical location with only 0.25% loss in efficiency. This stress reduction results in an increase in life from $10^9$ cycles to $10^{12}$ cycles at identical operating conditions. Thus the application of the invention provides a significant benefit.

For comparison, line C in FIG. 4 shows the stress at the eye hub edge in an analogous unshrouded blade. The stress without any modification of the unshrouded blade is less than that in the shrouded blade, and does not present the problem encountered in the shrouded blade. With beveling of the eye edge, stress reduction also occurs in the unshrouded blade, but much less rapidly with bevel angle than occurs with shrouded impellers, that is, with impellers that undergo both blade and shroud material removal.

While the invention has been described as an example with reference to specific embodiments, it will be appreciated that it is intended to cover all modifications and equivalents within the scope of the appended claims.

What is claimed is:

1. A radial flow turbine blade with reduced stress and increased useful life comprising a surface for fluid engagement having a blade hub, an outer shroud and an edge defining, in part, an outlet opening for axial fluid flow, said edge extending from said blade hub to the outer radial extremity of said shroud, and at least at its outer radial extremity being spaced axially into the blade at an angle of about 0.5° to about 8° from the radial line through said edge at the hub of said blade.

2. The blade as in claim 1 wherein said edge at least at its extremity is spaced axially into the blade at an angle of from about 0.5 to about 5° from the radial line through said edge at the hub of said blade.

3. The blade as in claim 1 wherein said blade at said edge is beveled at an angle from about 0.5° to about 5°.

4. The blade as in claim 1 wherein said blade includes an outer shroud except over an angle of from about 0.5° to about 5° from a radial line extending through the edge at the blade hub.

5. The blade as in claim 1 wherein at least a portion of said blade surface is radially tapered in thickness, whereby the mass of said blade is reduced in radially approaching the blade extremity.

6. A radial expansion impeller comprising blades each with an outer shroud wherein the impeller face having outlet openings for axial flow, at least near its radial extremity, has the shape of the surface of a cone with its vertex on the impeller centerline, the vertex having an included angle from about 179° to about 170°.

7. A method of reducing centrifugal stress in a shrouded radial flow turbine blade at the hub of the blade edge forming, in part, an outlet opening for axial flow, said method comprising spacing at least the extremity of said edge axially into the blade at an angle of about 0.5° to about 8° from a radial line through said edge at the hub of said blade.

8. The method of claim 7 further comprising spacing at least the extremity of said edge axially into the blade at an angle of about 0.5° to about 5° from a radial line through said edge at the hub of said blade.

9. The method of claim 7 further comprising beveling said blade at said edge at an angle of from about 0.5° to about 5°.

10. The method of claim 7 further comprising providing the blade with an outer shroud except over an angle from about 0.5° to about 5° from a radial line extending through the edge at the blade hub.

* * * * *